US010662825B2

(12) United States Patent
Hughes et al.

(10) Patent No.: US 10,662,825 B2
(45) Date of Patent: May 26, 2020

(54) CONTROL BASED ON MAGNETIC CIRCUIT FEEDBACK

(71) Applicant: Eaton Intelligent Power Limited, Dublin (IE)

(72) Inventors: Douglas Anthony Hughes, Novi, MI (US); Matthew Richard Busdiecker, Beverly Hills, MI (US); Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/342,376

(22) PCT Filed: Oct. 13, 2017

(86) PCT No.: PCT/US2017/056468

§ 371 (c)(1),
(2) Date: Apr. 16, 2019

(87) PCT Pub. No.: WO2018/075343

PCT Pub. Date: Apr. 26, 2018

(65) Prior Publication Data

US 2019/0234247 A1 Aug. 1, 2019

Related U.S. Application Data

(63) Continuation-in-part of application No. 15/432,026, filed on Feb. 14, 2017, now abandoned.
(Continued)

(51) Int. Cl.
*F01L 1/18* (2006.01)
*F01L 1/24* (2006.01)
(Continued)

(52) U.S. Cl.
CPC ..... *F01L 1/185* (2013.01); *F01L 1/24* (2013.01); *F01L 1/2405* (2013.01); *F01L 1/267* (2013.01);
(Continued)

(58) Field of Classification Search
CPC ... F01L 1/047; F01L 1/053; F01L 1/18; F01L 2001/186; F01L 1/267; F01L 1/46;
(Continued)

(56) References Cited

U.S. PATENT DOCUMENTS 3,040,217 A 6/1959 Conrad
4,203,397 A 5/1980 Soeters, Jr.
(Continued)

FOREIGN PATENT DOCUMENTS

DE 10310220 A1 9/2004
EP 2050933 A1 4/2009

*Primary Examiner* — Jorge L Leon, Jr.
(74) *Attorney, Agent, or Firm* — Paul V. Keller

(57) ABSTRACT

A method of operating an internal combustion engine of a type that has a combustion chamber, a moveable valve having a seat formed in the combustion chamber, a camshaft on which a cam is mounted, and a rocker arm assembly having a rocker arm and a cam follower configured to engage the cam as the camshaft rotates. The method includes obtaining rocker arm position data, using the rocker arm position data to obtain camshaft position information, and using the camshaft position information in an engine management operation.

20 Claims, 14 Drawing Sheets

Related U.S. Application Data

(60) Provisional application No. 62/409,263, filed on Oct. 17, 2016, provisional application No. 62/500,022, filed on Feb. 5, 2017.

(51) Int. Cl.
*F01L 13/00* (2006.01)
*F01L 1/26* (2006.01)
*F01L 1/053* (2006.01)

(52) U.S. Cl.
CPC ..... *F01L 13/0005* (2013.01); *F01L 13/0036* (2013.01); *F01L 2001/0537* (2013.01); *F01L 2001/186* (2013.01); *F01L 2013/001* (2013.01); *F01L 2013/101* (2013.01); *F01L 2101/00* (2013.01); *F01L 2105/00* (2013.01); *F01L 2201/00* (2013.01); *F01L 2820/03* (2013.01)

(58) Field of Classification Search
CPC ..... F01L 2013/101; F01L 2013/113; F01L 2201/00; F01L 2800/11; F01L 2800/14; F01L 2820/031; F01L 2820/042; F02D 35/028
USPC ..... 123/90.16, 90.27, 90.39, 90.41, 90.44
See application file for complete search history.

(56) References Cited

U.S. PATENT DOCUMENTS

| | | | | |
|---|---|---|---|---|
| 5,544,626 | A | 8/1996 | Diggs et al. | |
| 5,896,076 | A | 4/1999 | van Namen | |
| 6,318,318 | B1 | 11/2001 | Jahr | |
| 7,412,950 | B2 * | 8/2008 | Kuroki | F01L 1/181 123/90.16 |
| 8,985,074 | B2 | 3/2015 | Zurface et al. | |
| 2007/0163524 | A1 * | 7/2007 | Muraji | F01L 13/0063 123/90.16 |
| 2008/0006232 | A1 | 1/2008 | Gregor et al. | |

* cited by examiner

CONTROL BASED ON MAGNETIC CIRCUIT FEEDBACK

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an Engine Control Unit (ECU). A separate feed from the same source provides oil for hydraulic lash adjustment. This means that each rocker arm has two hydraulic feeds, which entails a degree of complexity and equipment cost. The oil demands of these hydraulic feeds may approach the limits of existing supply systems. In addition, there is a need to provide on board diagnostic information for cylinder deactivating and switching rocker arm assemblies.

SUMMARY

The present teachings relate to a valvetrain suitable for an internal combustion engine that includes a combustion chamber, a moveable valve having a seat formed within the combustion chamber, and a camshaft. The valvetrain includes a rocker arm assembly that has a rocker arm and a cam follower configured to engage a cam on the camshaft as the camshaft rotates. In the present teachings, the valvetrain further includes a latch assembly. In some of these teachings, the latch assembly includes a latch pin mounted on the rocker arm and an actuator that includes an electromagnet. The actuator parts are mounted on components distinct from the rocker arm, whereby the rocker arm and the latch pin have freedom of movement independent from the electromagnet. The actuator is operative on the latch pin through magnetic force and does not require a mechanical interface with the latch pin.

The latch pin is moveable between first and second positions. The electromagnet is operable to cause the latch pin to translate between the first and second positions. One of the first and second latch pin positions may provide a configuration in which the rocker arm assembly is operative to actuate the moveable valve in response to rotation of the camshaft to produce a first valve lift profile. The other latch pin position may provide a configuration in which the rocker arm assembly is operative to actuate the moveable valve in response to rotation of the camshaft to produce a second valve lift profile, which is distinct from the first valve lift profile, or the moveable valve may be deactivated.

Using electromechanical latch assemblies instead of hydraulically-actuated latches can reduce complexity and demands for oil in some valvetrain systems. Mounting the electromagnet on a part that is distinct from the rocker arm avoids running wires to the rocker arm. Rocker arms reciprocate rapidly over a prolonged period and in proximity to other moving parts. Wires attaching to a rocker arm could be caught, clipped, or fatigued and consequently short out.

According to some aspects of the present teachings, the electromagnet is operative to cause the latch pin to translate between the first and second positions through magnetic flux following a magnetic circuit that includes a structural component of the valvetrain. The structural component may be a load-bearing member of the valvetrain. In some of these teachings, the structural component is the rocker arm on which the latch pin is mounted. In some of these teachings, the structural component is a pivot that provides a fulcrum for the rocker arm. In some of these teachings, both the rocker arm and a pivot that provides a fulcrum for the rocker arm are part of the magnetic circuit. The structural components may complete the magnetic circuit in the sense that if those components were replaced by ones made entirely from aluminum, the electromagnet would no longer be operative to cause the latch pin to translate between the first and second positions. Using these structural components to complete the magnetic circuit enables the latch assembly to have a compact design suitable for packaging within the limited space available under a valve cover.

In some of these teachings, the magnetic circuit also includes the latch pin. In an alternative teaching, rather than passing through the latch pin, the magnetic circuit is completed by another part that is mounted on the rocker arm and is positioned to act against the latch pin. The magnetic flux may be generated by the electromagnet and/or one or more permanent magnets. In some of these teachings, the electromagnet is operative to actuate the latch pin by generating, or ceasing to generate, the flux. In some of these teachings, the electromagnet is operative to actuate the latch pin by diverting the flux.

According to some aspects of the present teachings, the electromagnet is mounted in a position offset from the latch pin. More specifically, in some of these teachings the electromagnet is mounted in a position such that a line oriented in the direction along which the latch pin translates between its first and second positions while the cam is on base circle and passing through the latch pin while the cam is on base circle will not intersect the electromagnet or the space the electromagnet encloses. The present teachings enable mounting the electromagnet in an offset position, which facilitates packaging.

In some of these teachings, the electromagnet, a permanent magnet, or a combination of one or more electromagnets and permanent magnets are positioned and functional to provide a magnetic field effective to hold the latch pin in at least one of the first and second positions through magnetic flux that follows the magnetic circuit. In some of these teachings, the electromagnet is operable to alter the magnetic flux in the circuit and thereby cause the latch pin to translate between the first and second positions.

In some of these teachings, the actuator is operative to change a magnetic force on the latch pin or an abutting part mounted on the rocker arm. In some of these teachings, the actuator is operative to change a magnetic force on the latch pin. The part on which the magnetic force acts is magnetized. The change in magnetic force may include the application of the magnetic force or the removal of the magnetic force. In some of these teachings, the change in magnetic force includes a reversal of a direction in which magnetic force acts on the part.

In some of these teaching, all or a portion of the part included in the magnetic circuit is formed of a magnetically susceptible material that if replaced with aluminum would render the electromagnet inoperative to cause the latch pin to translate between the first and second positions. In some of these teachings, the magnetically susceptible material is a low coercivity ferromagnetic material.

In some of these teachings, magnetic flux following the magnetic circuit in one of a forward and a reverse direction enters the latch pin crossing directly or across an air gap from the rocker arm and leaves the latch pin crossing directly or across an air gap to a pole piece that is mounted to a component distinct from the rocker arm, whereby the rocker arm is operative to move independently from the pole piece. The pole piece may be in a fixed position relative to the electromagnet. The structure determining this flux paths relates to a compact design.

In some of these teaching, magnetic flux following the magnetic circuit passes between the latch pin and a pole piece mounted to a component distinct from the rocker arm across a variable width air gap. The width of the air gap varies as the latch pin translates between the first and second positions. In some of these teachings, the width of the air gap also varies as the rocker arm pivots during operation of the rocker arm assembly. The term pole piece as used herein may encompass any structure that completes a magnetic circuit regardless of the position of the pole piece within the magnetic circuit. In some of these teachings, the electromagnet includes a coil around a solid immovable core. That core may be considered a pole piece.

In some of these teachings, the valvetrain is installed in an engine having a cylinder head and one or more parts including a valve cover that define the limits of an enclosed space underneath the valve cover. In some of these teachings, the parts of the engine along the shortest path between the latch pin and the nearest outer edge of that enclosed space consist essentially of one or more pole pieces that complete the magnetic circuit. The outer edge may be defined by the cylinder head. The latch pin may extend outward from the back of the rocker arm assembly and there may be only a relatively narrow gap between the rocker arm assembly and the cylinder head. The electromagnet may be too large to fit within that gap; however, the gap may accommodate a pole piece that completes a magnetic circuit that includes the latch pin and the electromagnet.

In some aspects of the present teachings, the magnetic flux passes through a pivot for the rocker arm assembly. The pivot may provide a fulcrum for the rocker arm. Passing the flux through the pivot may provide a pathway through which the flux may be brought close to the latch pin or a co-acting part at a location within the rocker arm. In some of these teachings, the magnetic flux passes through the structure of the pivot. In some of these teachings, the pivot structure forms part of a magnetic circuit through which the actuator operates such that replacing that structure with aluminum would render the electromagnet inoperative to cause the latch pin to translate between the first and second positions. In some of these teachings, the pivot is made primarily of low coercivity ferromagnetic material. In some of these teachings, the pivot is a lash adjuster. In some of these teachings, the pivot is a hydraulic lash adjuster. The pivot may be relatively stationary compared to the rocker arm and flux from the electromagnet may be transferred to the pivot relatively easily.

In some of these teachings, the electromagnet is mounted to a structure that abuts a pivot providing a fulcrum for the rocker arm on which the latch pin is mounted. In some of these teachings, the electromagnet is mounted to the pivot. In some of these teachings, the electromagnet is mounted on a bracket that abuts two pivots, one associated with each of two rocker arm assemblies. In some of these teachings, the electromagnet is mounted on a bracket that abuts four pivots, each associated with a different rocker arm assembly. In some of these teachings, the electromagnet is mounted on a bracket that abuts a spark plug tower. In some of these teachings, the electromagnet is mounted on a bracket that encircles a spark plug tower. These structures may facilitate correctly positioning the electromagnet. The mounting bracket may be secured to a cylinder head. In some of these teachings, a structure through which the electromagnet is mounted also provides a component of the magnetic circuit.

In some aspects of the present teachings, there are two of the rocker arm assemblies and two of the latch pins and the electromagnet is operable to simultaneously cause both latch pins to translate between first and second positions. In some of these teachings, the two latch pins form parts of a single magnetic circuit for the electromagnet. In some of these teachings, the two rocker arm assemblies are side-by-side. In some of these teachings, the electromagnet is located between the two rocker arm assemblies. In some of these teachings, the magnetic circuit further includes two pivots, each associated with a different one of the two rocker arm assemblies.

In some of the present teachings, the valvetrain is installed within an engine having a combustion chamber and the electromagnet of the actuator is mounted in a position that is fixed with respect to the combustion chamber. In some of these teachings, the electromagnet is mounted to a cylinder head, a cam carrier, a camshaft journal, or a valve cover of the engine.

In some of these teachings, the electromagnet is mounted to a pivot. Mounting the electromagnet to a part that is distinct from the rocker arm and that is not constrained to move with the rocker arm allows wires powering the electromagnet to be maintained in relatively static positions.

In some of the present teachings, the latch pin is mounted on a rocker arm of the rocker arm assembly and, along with the rocker arm, has a range of motion relative to the actuator. An air gap in a magnetic circuit through which the actuator operates on the latch pin may vary in width in conjunction with this relative motion. The rocker arm position and thus the air gap width may be affected by rotation of the camshaft. In some of these teachings, the rocker arm assembly and the latch assembly are configured such that the actuator does not need to be operative on the latch pin except within a limited portion of rocker arm's range of motion. Actuation of the latch pin may occur only when the cam is on base circle.

In some of these teachings, the rocker arm assembly is configured whereby the rocker arm to which the latch pin is mounted remains substantially stationary when the latch pin is in a non-engaging configuration. The engaging configuration may be maintained independently from the actuator. In some of these teachings, the engaging configuration is maintained by a spring. In some of these teachings, in the engaging configuration, with each cycle of the cam the rocker arm reaches a position in which the actuator is operative to induce a magnetic force on the latch pin sufficient to overcome the spring force and hold the latch pin in the non-engaging configuration. The actuator need not be so operative throughout the cam cycle.

Some aspects of the present teachings provide a module for installation in an engine. The module includes a rocker arm assembly, a pivot, and an actuator according to the present teachings. In some of these teachings, the pivot is secured to the rocker arm assembly. In some of these teachings, the pivot is a hydraulic lash adjuster. The module may be convenient for installation in an engine and may facilitate correct positioning of the actuator relative to the rocker arm. A connecting piece that secures the pivot to the rocker arm assembly prior to installation may be removed after installation.

Some aspects of the present teachings relate to using a valvetrain within a method of operating an internal combustion engine that includes the valvetrain. In some of these teachings, the valvetrain include a rocker arm assembly that has a latch pin providing the rocker arm assembly with engaging and non-engaging configurations. In some of these teachings, the method includes operating the engine with the latch pin in one of the engaging and non-engaging configurations. An electromagnet of an actuator that is mounted within the engine but on a component distinct from a rocker arm on which the latch pin is mounted is energized to cause the latch pin to translate and thereby change the rocker arm assembly configuration. The engine is then further operated with the rocker arm assembly in the other of the engaging and non-engaging configurations. In some of these teaching, the latch pin is actuated by magnetic flux that passes through the rocker arm. In some of these teaching, the latch pin is actuated through a magnetic circuit that includes a structural component of the rocker arm assembly.

Some aspects of the present teachings relate to a method of operating an internal combustion engine in which an electrical circuit that includes an electromagnet operative to actuate a rocker arm-mounted latch pin is used to provide rocker arm position information. The method is applicable to an internal combustion engine of a type that includes a combustion chamber, a moveable valve having a seat formed in the combustion chamber, a camshaft on which a cam is mounted, a rocker arm assembly including a rocker arm and a cam follower configured to engage the cam as the camshaft rotates, and a latch assembly including a latch pin mounted on the rocker arm and an actuator that includes an electromagnet mounted to a component distinct from the rocker arm. The electromagnet is operative to cause the latch pin to translate between the first and the second position through magnetic flux that follows a magnetic circuit that passes through the latch pin and includes an air gap that varies in width in relation to a motion of the rocker arm that actuates the moveable valve. As the air gap varies in width, the magnetic reluctance of the magnetic circuit and the inductance of the electromagnet will also vary. The inductance affects current and voltage in an electrical circuit that includes the electromagnet. In some of these teachings, that effect is used to determine the rocker arm position. In some of these teachings, the method includes analyzing data relating to a current or voltage in an electrical circuit comprising the electromagnet to obtain rocker arm position information. The data may be gathered over a span of time and analyzed to determine the valve lift profile. The data is obtained while the engine is operating and the camshaft is rotating. These methods allow the same electromagnet that is used to actuate the latch pin to also be used to provide on-board diagnostic (OBD) information or for engine management.

In some of these teachings, a circuit including the electromagnet is powered to facilitate gathering the data. In some of these teachings, the electrical circuit is given a pulse insufficient to actuate the latch pin and the data relates to a current or voltage induced by the pulse. In some of these teachings, gathering the data comprises gathering the data over a cam cycle through which the electrical circuit is continuously powered with a current that does not maintain or affect the latch pin position. In some of these teachings, the electromagnet is powered with a DC current to actuate the latch pin and is powered with an AC current while gathering the data. The AC current need not affect the latch pin position. The AC signal may be driven on top of the DC current.

In some of these teachings, the rocker arm position information is used to perform a diagnostic. In some of these teachings, the method includes reporting a diagnostic result. In some of these teachings, the diagnostic determination is whether the rocker arm assembly is in the engaging configuration. In some of these teachings, the diagnostic determination is whether the latch assembly is operating correctly.

Rocker arm position information may be used to make a variety of diagnostic determinations. In some of these teachings, rocker arm position information is used to detect wear in one or more valve lift components. In some of these teachings, rocker arm position information is used to detect a collapsed lifter. In some of these teachings, rocker arm position information is used to detect valve float. In some of these teachings, rocker arm position information is used to detect a broken valve spring.

In some of these teachings, the circuit comprising the electromagnet is monitored to determine whether an event referred to as a "critical shift" has occurred. A critical shift is an event in which a latch pin slips out of engagement while the cam is lifting a rocker arm. When this happens, the rocker arm to which the latch pin is mounted rapidly returns to the position normally associated with base circle. If there is magnetic flux going through the magnetic circuit at the time of the critical shift, the current in the circuit comprising the electromagnetic will be affected and the effect may be used to detect the critical shift. In some of these teachings, the latch assembly includes a permanent magnet configured to maintain flux in the magnetic circuit while the electromagnet is off.

Some aspects of the present teachings relate to a method of using a valvetrain that provides rocker arm position information to control an engine. According to these teachings, the rocker arm position information is used to determine camshaft position, which is used in an engine management operation. In some of these teachings, the engine management operation includes regulating an ignition timing. In some of these teachings, the engine management operation includes regulating the timing of a fueling event. The rocker arm moves in relation to camshaft rotation. In some of these teachings, obtaining camshaft position information comprises determining a time at which the rocker arm reached maximum lift.

In some of these teachings, rocker arm position data is collected from two or more rocker arm assemblies. Where both rocker arm assemblies are actuated through one camshaft, obtaining data from two or more distinct rocker arms allows for a more accurate determination of camshaft position. Where the two rocker arm assemblies are actuated by different camshafts, the information may be used to determine the phase relationship between the camshafts.

In some of these teachings, rocker arm position detection is used to provide camshaft position sensing. In some of these teachings, the engine management operation is performed by a controller that is not receiving data regarding the position of the camshaft from a conventional camshaft position sensor. The engine may include a camshaft position sensor of a conventional type that is not currently functioning. In some of these teachings, using the camshaft position information in an engine management operation comprises using the camshaft position information in conjunction with data from a crank angle sensor to determine the phase relationship between a camshaft and a crankshaft. In some of these teachings the engine management operation comprises controlling a cam phaser.

In some of these teachings, the cam includes two lift lobes and the rocker arm assembly includes a latch enabling cylinder deactivation. The rocker arm position information may enable an accurate determination of where the cam is in the dual lift cycle. In a method according to these teachings, the latch is actuated twice per cam cycle, whereby through two or more cam cycles the latch is engaged whenever the cam follower is on one of the two lift lobes and disengaged whenever the cam follower is on the other of the two lift lobes. Accurate determination of the cam shaft position is an enabler for this method.

In some of the present teachings, the rocker arm to which the latch pin is mounted is of a design that was put into production for use with a hydraulically actuated latch. In some of these teachings, the rocker arm to which the latch pin is mounted includes a hydraulic chamber adapted to receive a hydraulically actuated latch pin. In some of these teachings, a magnetically actuated latch pin is installed in that hydraulic chamber. Rocker arms for commercial applications are typically manufactured using customized casting and stamping equipment requiring a large capital investment. The present disclosure provides designs that allow these same rocker arms to be used with a magnetically actuated latch pin.

Some aspects of the present teachings relate to a method of retrofitting for electromagnetic latching a rocker arm manufactured for hydraulic latching. The method includes installing a latch pin within a hydraulic chamber of the rocker arm with a portion of the latch pin protruding from the chamber. The rocker arm is installed within an engine in a magnetic circuit in which flux from an electromagnet will enter the latch pin through the rocker arm and leave the rocker arm across an air gap between the protruding portion of the latch pin and a pole piece of the latch assembly.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1A:
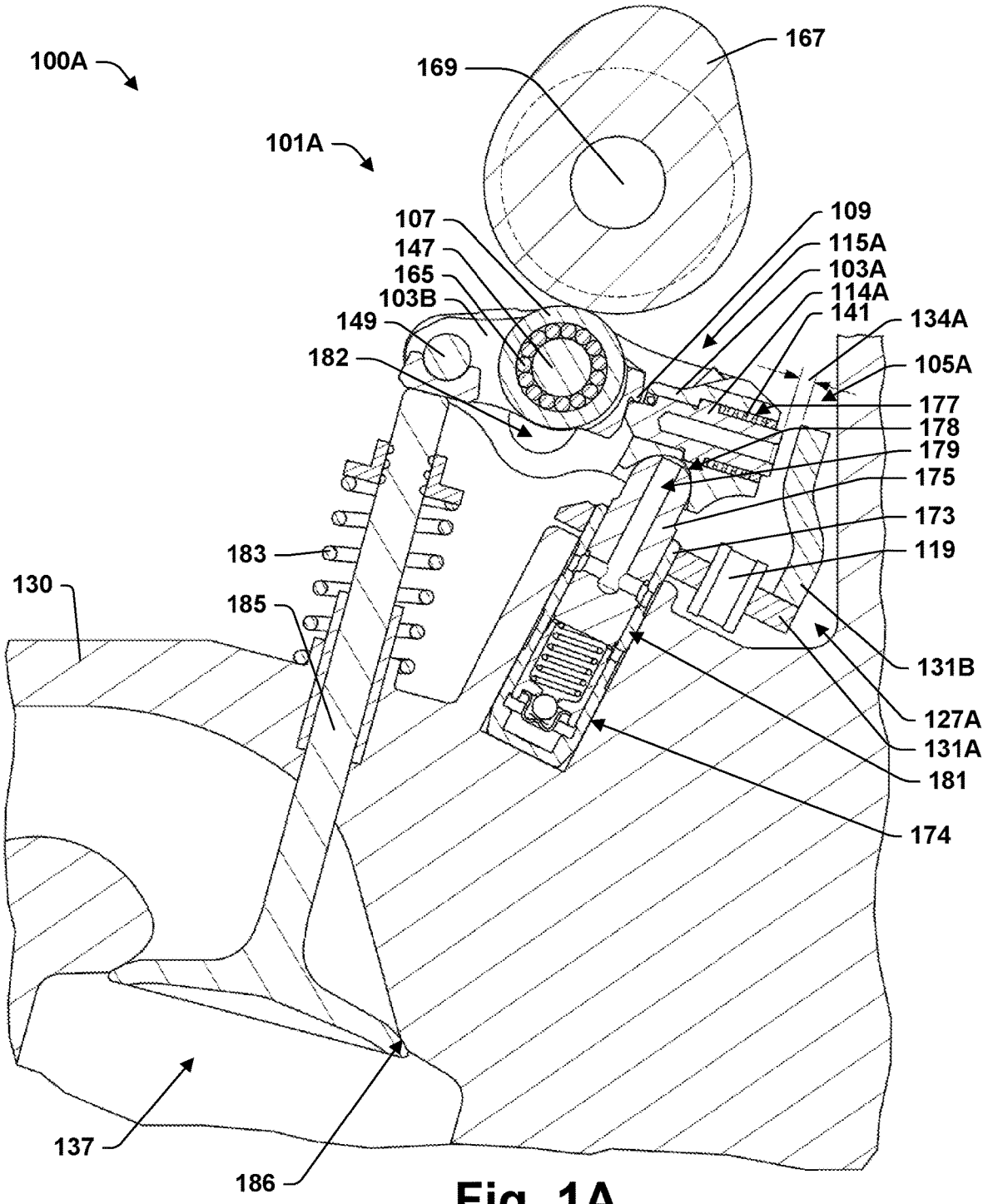
FIG. 1A is a partial cross-section of an internal combustion engine with a valvetrain according to some aspects of the present teachings.

In the drawings, some reference characters consist of a number followed by a letter. In this description and the claims that follow, a reference character consisting of that same number without a letter is equivalent to a listing of all reference characters used in the drawings and consisting of that same number followed by a letter. For example, "valvetrain 101" is the same as "valvetrain 101A, 101B".

FIG. 1A provides a partial-cutaway side view of a portion of an engine 100A including a valvetrain 101A in accordance with some aspects of the present teachings. Engine 100A includes a cylinder head 130 in which a combustion chamber 137 is formed, a moveable valve 185 having a seat 186 formed within combustion chamber 137, and a camshaft 169 on which a cam 167 is mounted. Moveable valve 185 may be a poppet valve. Valvetrain 101A includes rocker arm assembly 115A, hydraulic lash adjuster (HLA) 181, and latch assembly 105A. Rocker arm assembly 115A includes rocker arm 103A (an outer arm) and rocker arm 103B (an inner arm). HLA 181 is an example of a pivot. It provides a fulcrum on which rocker arm 103A pivots. A pivot may alternatively be a mechanical lash adjuster, a post that provides a fulcrum on which a rocker arm pivots, or a rocker shaft. Outer arm 103A and inner arm 103B are pivotally connect through shaft 149. A cam follower 107 may be mounted to inner arm 103B through bearings 165 and shaft 147. Cam follower 107 is configured to engage cam 167 as camshaft 169 rotates. Cam follower 107 is a roller follower but could alternatively be another type of cam follower such as a slider.

Figure 1B:
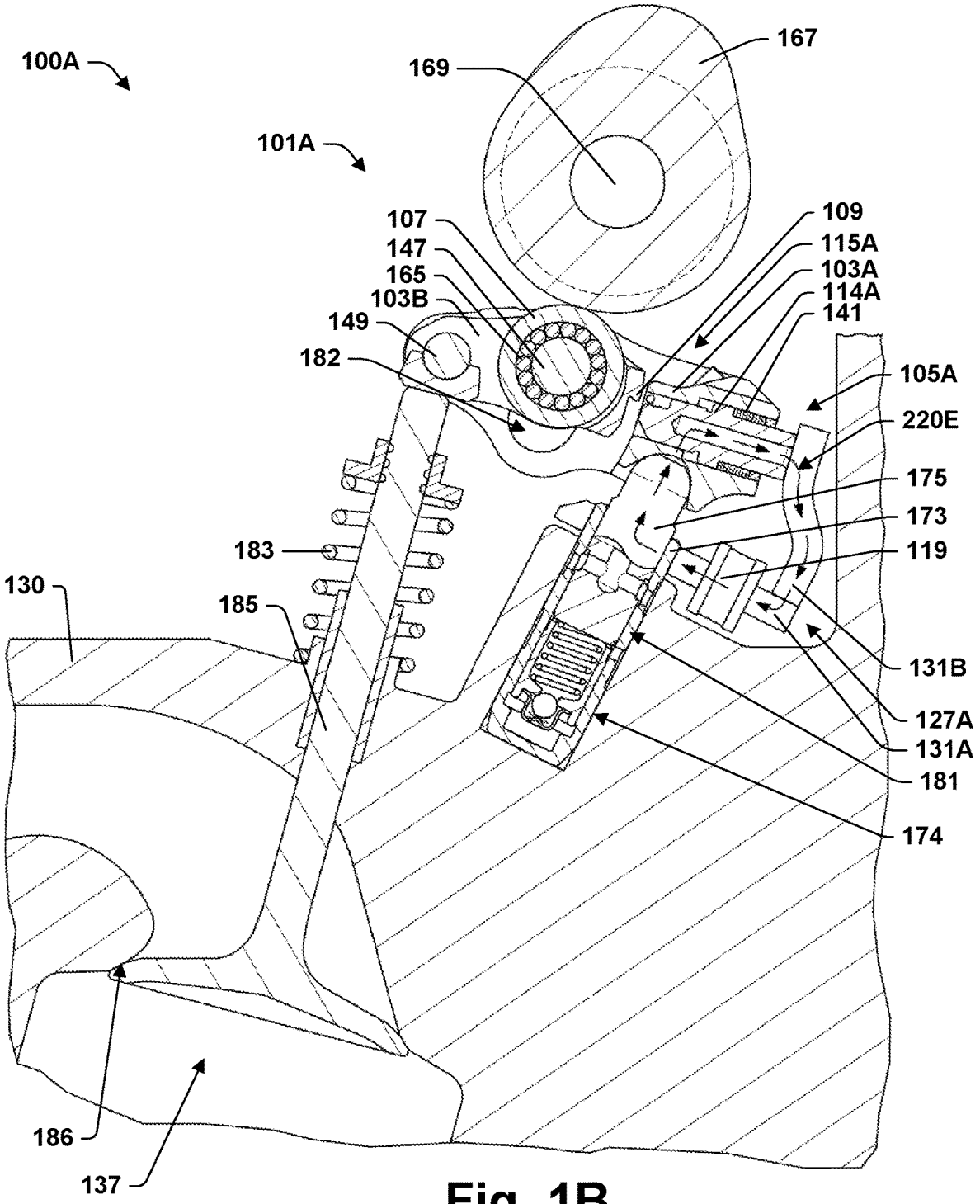
FIG. 1B is the same view as FIG. 1A, but with the latch pin moved from an engaging to a non-engaging position.

Shaft 147 protrudes outward through openings 182 in the sides of outer arm 103A to engage torsion springs 145 (see FIG. 2A), which are mounted to outer arm 103A. If inner arm 103B pivots downward relative to outer arm 103A on shaft 149 as shown in FIG. 1D, torsion springs 145 act on shaft 147 to drive inner arm 103B to pivot back toward the position shown in FIG. 1A.

Latch assembly 105A includes an actuator 127A mounted to HLA 181 and a latch pin 114A mounted on rocker arm 103A. In this specification, the terms "latch pin" and "rocker arm" encompass the most basic structures that would be commonly understood as constituting a "latch pin" or a "rocker arm" and may further encompass parts that are rigid and rigidly held to that most basic structure. A rocker arm assembly is operative to form one or more force transmission pathways between a cam and a moveable valve. A rocker arm is a lever operative to transmits force from the cam along one or more of those pathways. The most basic structure of the rocker arm, which is its core structure, is capable of bearing the load and carrying out that function.

Latch pin 114A is translatable between a first position and a second position. The first position may be an engaging position, which is illustrated in FIG. 1A. The second position may be a non-engaging position, which is illustrated in FIG. 1B. A spring 141 mounted within outer arm 103A may be configured to bias latch pin 114A into the engaging position. When latch pin 114A is in the engaging position, rocker arm assembly 115A may be described as being in an engaging configuration. When latch pin 114A is in the non-engaging position, rocker arm assembly 115A may be described as being in a non-engaging configuration.

Figure 1C:
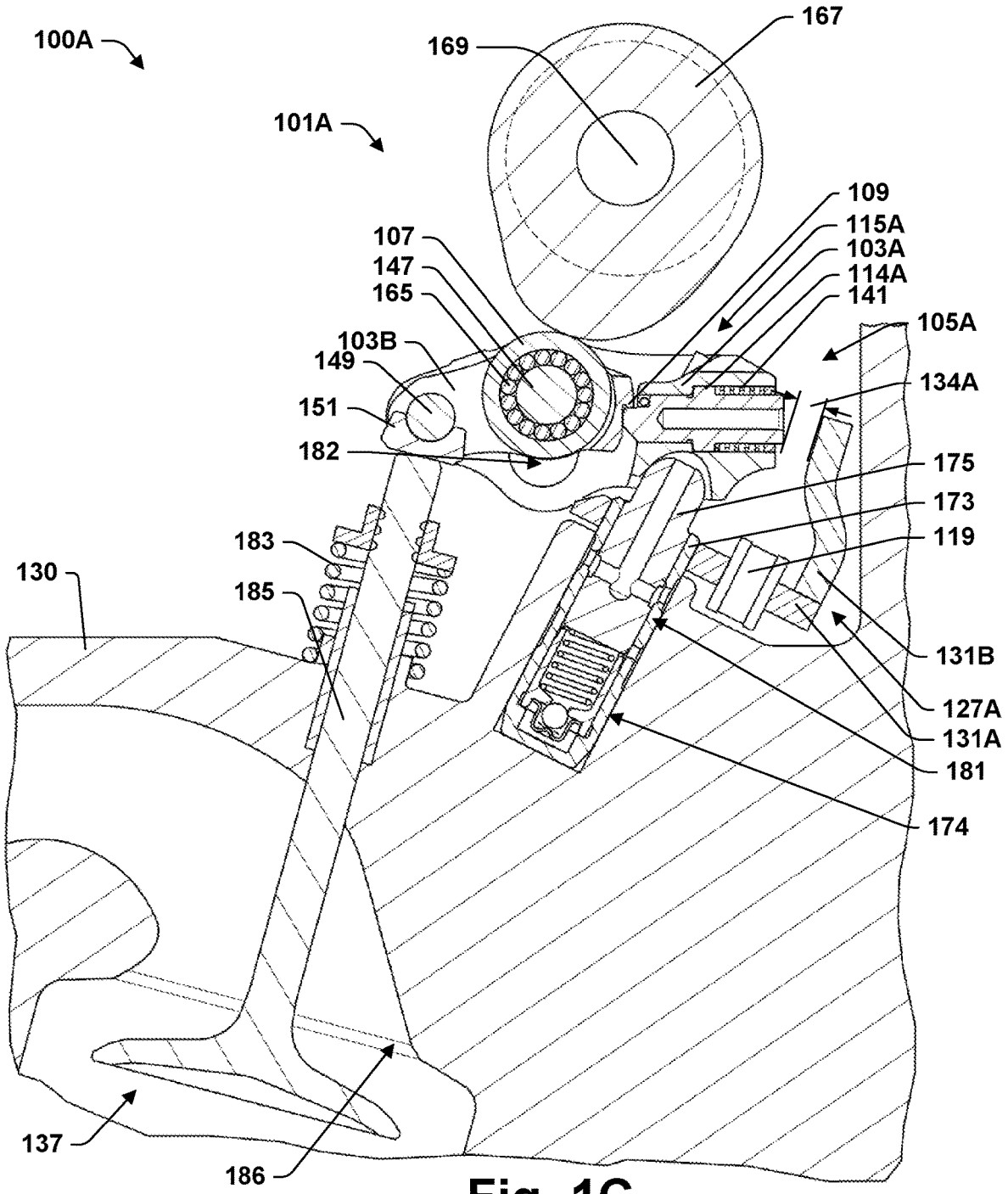
FIG. 1C is the same view as FIG. 1A, but with the cam risen off base circle.
Figure 1D:
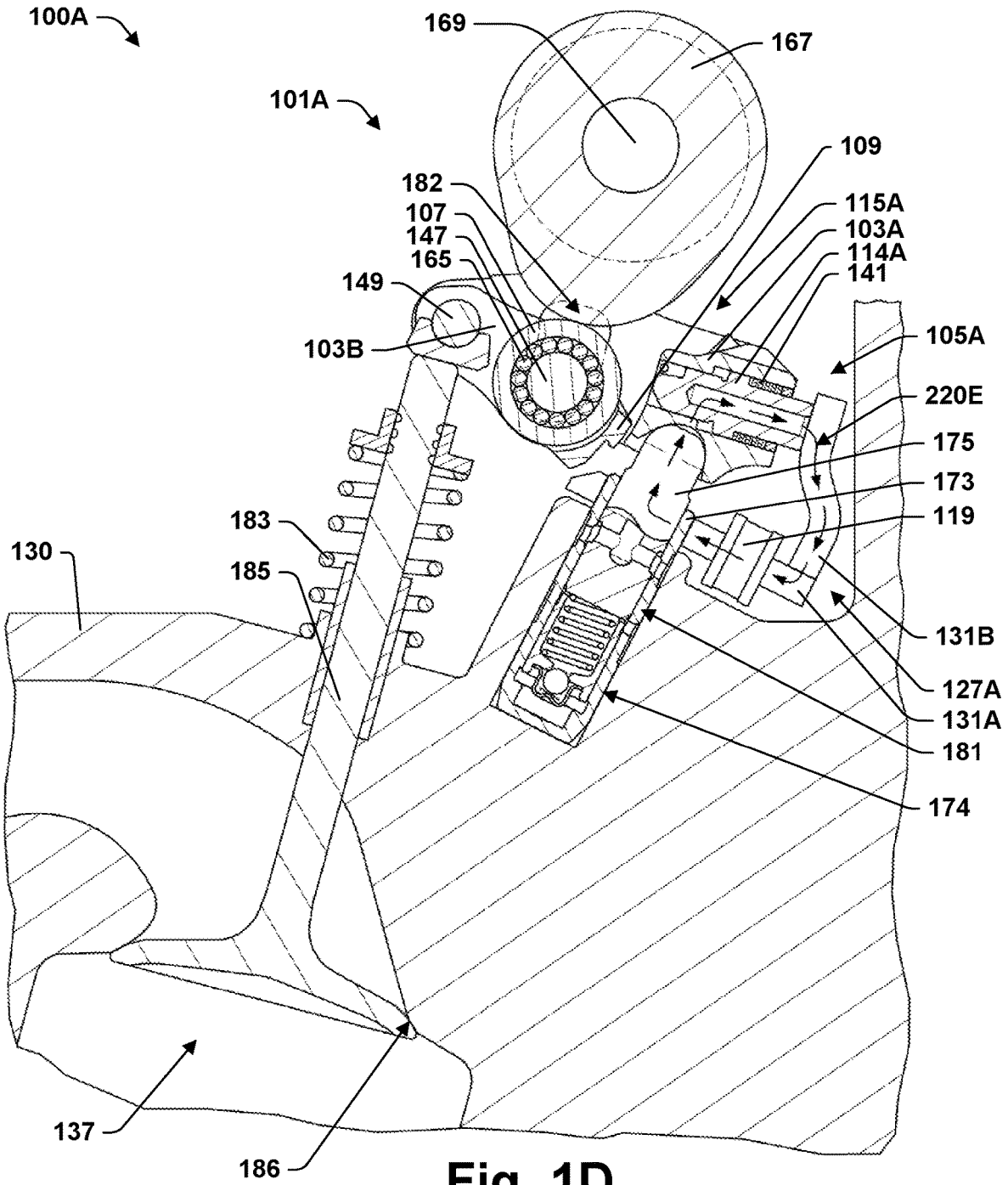
FIG. 1D is the same view as FIG. 1B, but with the cam risen off base circle.

FIG. 1C shows the effect if cam 167 rises off base circle while latch pin 114A is in the engaging position. Latch pin 114A may engage lip 109 of inner arm 103B, after which inner arm 103B and outer arm 103A may be constrained to move in concert. HLA 181 may provide a fulcrum on which inner arm 103B and outer arm 103A pivot together as a unit, driving down on valve 185 via an elephant's foot 151, compressing valve spring 183 against cylinder head 130, and lifting valve 185 off its seat 186 within combustion chamber 137 with a valve lift profile determined by the shape of cam 167. The valve lift profile is the shape of a plot showing the height by which valve 185 is lifted of its seat 186 as a function of angular position of camshaft 169.

FIG. 1D shows the effect if cam 167 rises off base circle while latch pin 114A is in the non-engaging position. Cam 167 still drives inner arm 103B downward, but instead of compressing valve spring 183, inner arm 103B pivots on shaft 149 against the resistance of torsion springs 145. Torsion springs 145 yield more easily than valve spring 183. Outer arm 103A remains stationary and valve 185 remains on its seat 186. Accordingly, the non-engaging configuration may provide deactivation of a cylinder with a port controlled by valve 185. Alternatively, there may be additional cams that operate directly on outer arm 103A. These additional cams may provide a lower valve lift profile than cam 167. Therefore, the non-engaging configuration for rocker arm assembly 115A may provide an alternate valve lift profile and rocker arm assembly 115A may provide a switching rocker arm.

Actuator 127A may include an electromagnet 119 and pole pieces 131A and 131B. As the term is used in this disclosure, a pole piece may be any part formed of low coercivity ferromagnetic material and located in a position where it is operative to complete a magnetic circuit. Actuator 127A is mounted to HLA 181 through pole piece 131A, which also provides a core for electromagnet 119. HLA 181 includes an inner sleeve 175 and an outer sleeve 173. Outer sleeve 173 is installed within a bore 174 formed in cylinder head 130. Outer sleeve 173 may rotate within bore 174, but is otherwise substantially stationary with respect to cylinder head 130. Inner sleeve 175 is telescopically engaged within outer sleeve 173 and provides a fulcrum on which outer arm 103A pivots. That fulcrum may be hydraulically raised or lowered to adjust lash.

Latch pin 114A, outer arm 103A, inner sleeve 175, and outer sleeve 173 may be made entirely of low coercivity ferromagnetic material. Together with pole pieces 131A and 131B, they may form a magnetic circuit 220E, which is shown in FIG. 1B. A magnetic circuit is a structure operative to be the pathway for an operative portion of the magnetic flux from a magnetic flux source. Magnetic circuit 220E provides a pathway for magnetic flux that is generated by electromagnet 119. The magnetic flux that is generated by electromagnet 119 and follows magnetic circuit 220E is operative to actuate latch pin 114A from its engaging to its non-engaging position. When electromagnet 119 is first energized, magnetic circuit 220E includes the air gap 134A, which is shown in FIG. 1A. Energizing electromagnet 119 generates magnetic flux that polarizes low coercivity ferromagnetic materials within circuit 220E and results in magnetic forces on latch pin 114A that tend to drive it to the non-engaging position shown in FIG. 1B. Driving latch pin 114A to the non-engaging configuration reduces air gap 134A and the magnetic reluctance in circuit 220E. If electromagnet 119 is switched off, spring 141 may drive latch pin 114A back into the engaging configuration and reopen air gap 134A.

Magnetic circuit 220E passes through rocker arm 103A. In this disclosure, "passing through" a part means passing through the smallest convex volume that can enclose the part. When asserting that a magnetic flux that is operative "passes through" a part, the meaning is that the entirety of a portion of the magnetic flux that is sufficient to be operative passes through that part. In other words, the operability is achieved independently from any flux that follows a circuit that does not pass through the part.

Magnetic circuit 220E passes through the structure of rocker arm 103A. "Passing through the structure" of a part means passing through the material that makes up that part. If the part forms a low reluctance pathway for the magnetic flux, it may help define the magnetic circuit. Low coercivity ferromagnetic materials in particular are useful in establishing magnetic circuits. In some cases, the magnetic properties of a part are essential to the formation of a magnetic circuit through which actuator 127 is operative. A touchstone for these cases is that if that part were replaced by an aluminum part, an operability dependent on that circuit would be lost. Aluminum is an example of a paramagnetic material. For the purposes of this disclosure, a paramagnetic material is one that does not interact strongly with magnetic fields.

Figure 1E:
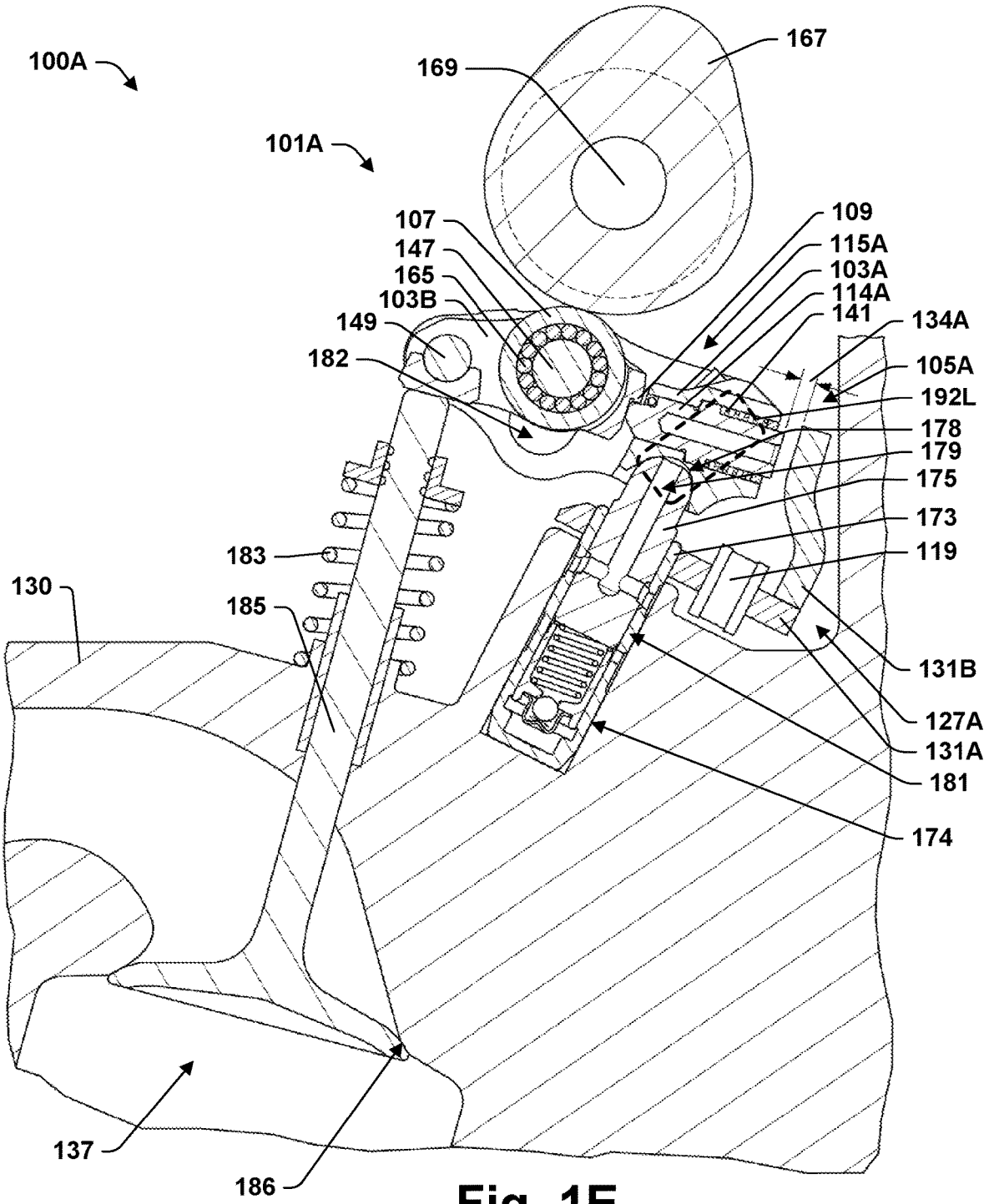
FIG. 1E illustrates a modification of the valvetrain in FIG. 1A according to some aspects of the present teachings.

HLA 181 and latch pin 114A form essential parts of magnetic circuit 220E. In other words, if either of these parts were replaced by ones made entirely of aluminum, actuator 127 would cease to be operative to actuate latch pin 114A. Depending on the strength of electromagnet 109, the core structure of rocker arm 103A may also form an essential part of magnetic circuit 220E. Rocker arm 103A may be formed of low coercivity ferromagnetic material that provides a low reluctance pathway for magnetic flux crossing from HLA 181 to latch pin 114A. On the other hand, HLA 181 brings magnetic flux sufficiently close to latch pin 114A that magnetic flux may cross between HLA 181 and latch pin 114A following magnetic circuit 220E regardless of the material in between. In some of these teachings, pole pieces 192L are positioned to the sides of rocker arm 103A as illustrated in FIG. 1E to facilitate transmission of magnetic flux from HLA 181 to latch pin 114A within rocker arm 103A.

Latch pin 114A, by virtue of being mounted to outer arm 103A, has a range of motion relative to combustion chamber 137 and actuator 127A. This range of motion may be primarily the result of outer arm 103A pivoting on HLA 181 when rocker arm assembly 115A is in the engaging configuration. On the other hand, the position of latch 117A relative to actuator 127A may be substantially fixed while latch 117A is in the non-engaging configuration. Extension and retraction of HLA 181 may introduce some relative motion, but excluding a brief period during start-up, the range of motion introduced by HLA 181 may be negligible. As long as latch pin 114A is in the non-engaging configuration, magnetic circuit 220E may remain operative whereby electromagnet 119 may act through that circuit to maintain latch pin 114A in the non-engaging configuration.

Figure 2A:
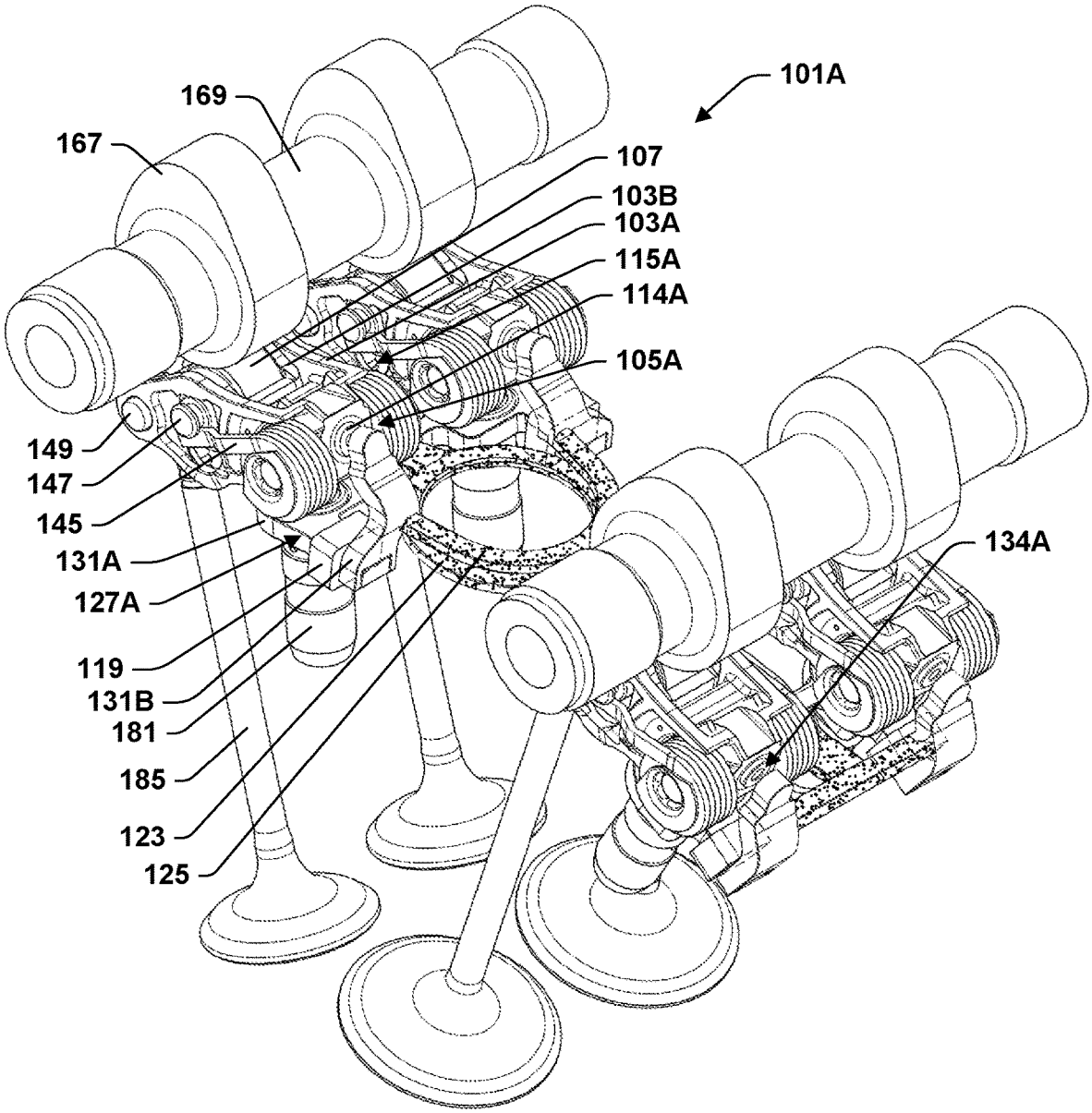
FIG. 2A provides a perspective view of a portion of the valvetrain of the engine illustrated by FIG. 1A.
Figure 2B:
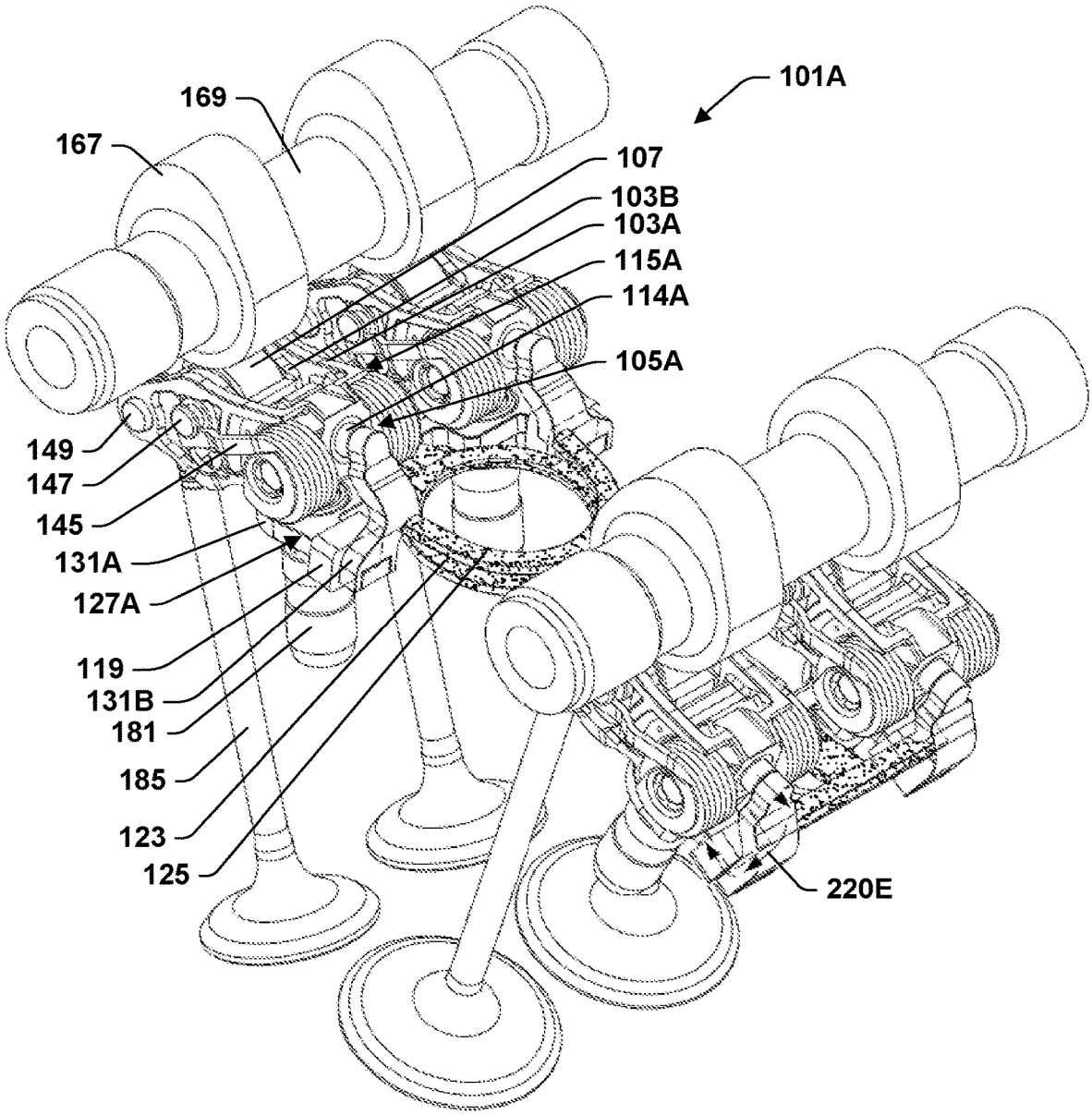
FIG. 2B provides the same view as FIG. 2A, but with the latch pins moved from engaging to non-engaging positions.

FIGS. 2A and 2B are perspective views of a portion of the valvetrain 101A, which is in accordance with some aspects of the present teachings and is a part of engine 100A. As shown by these illustrations, actuator 127A may be one of four supported by a common mounting frame 123. The four actuators 127A may control two intake ports and two exhausts ports for one engine cylinder. Mounting frame 123 may include four pole pieces 131A joined with a paramagnetic connecting structure 122.

Figure 3A:
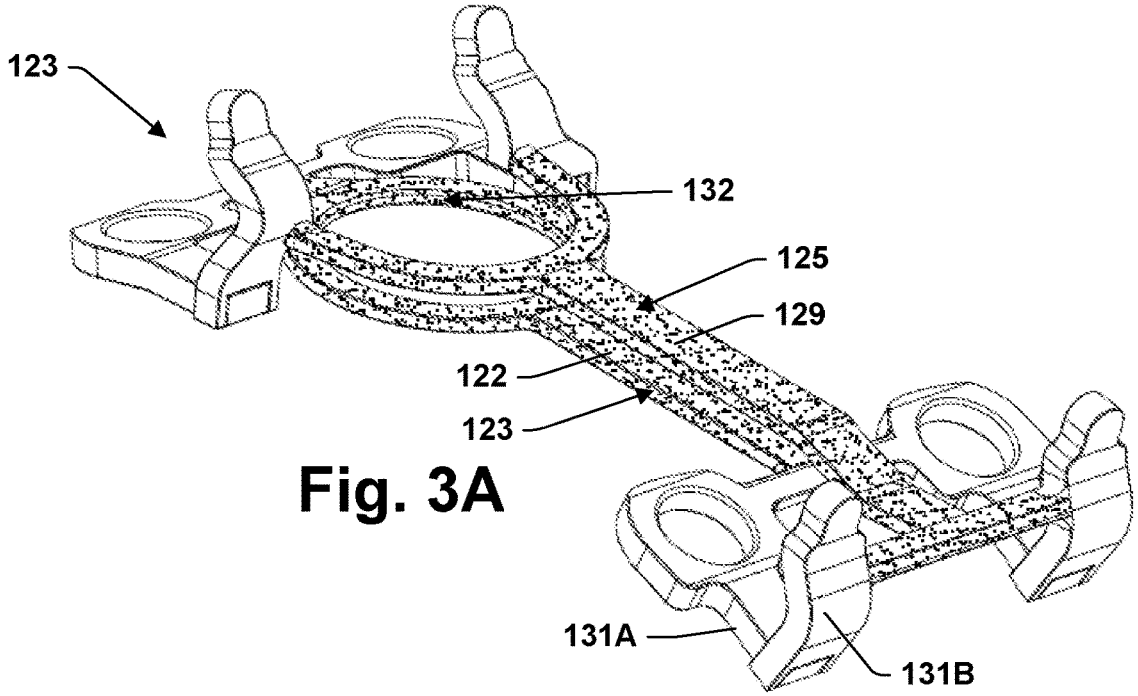
FIG. 3A provides a perspective view of an actuator mounting frame according to some aspects of the present teachings, which is used in the valvetrain of FIG. 2A.
Figure 3B:
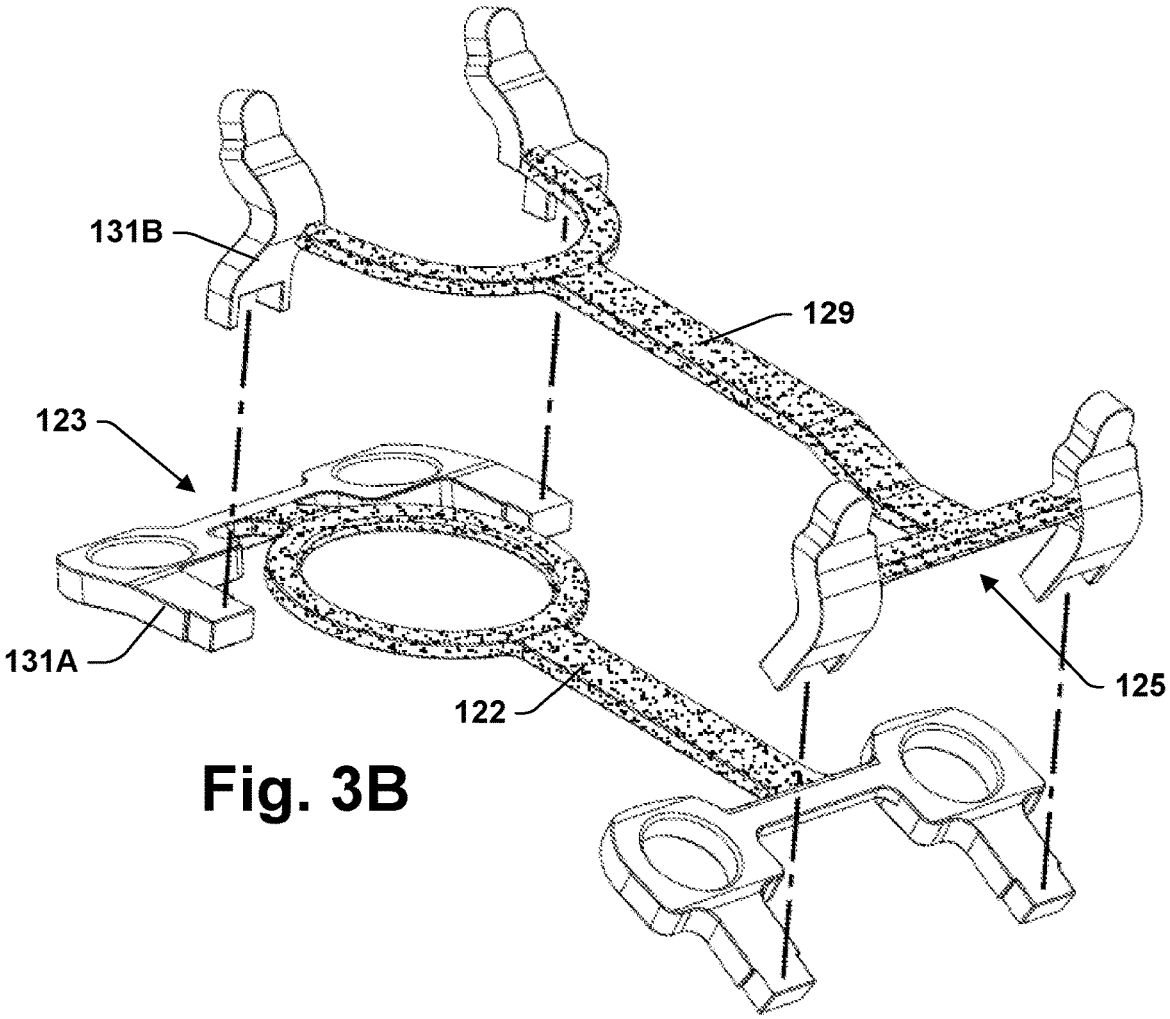
FIG. 3B provides an explode view of the mounting frame of FIG. 3A.
Figure 3C:
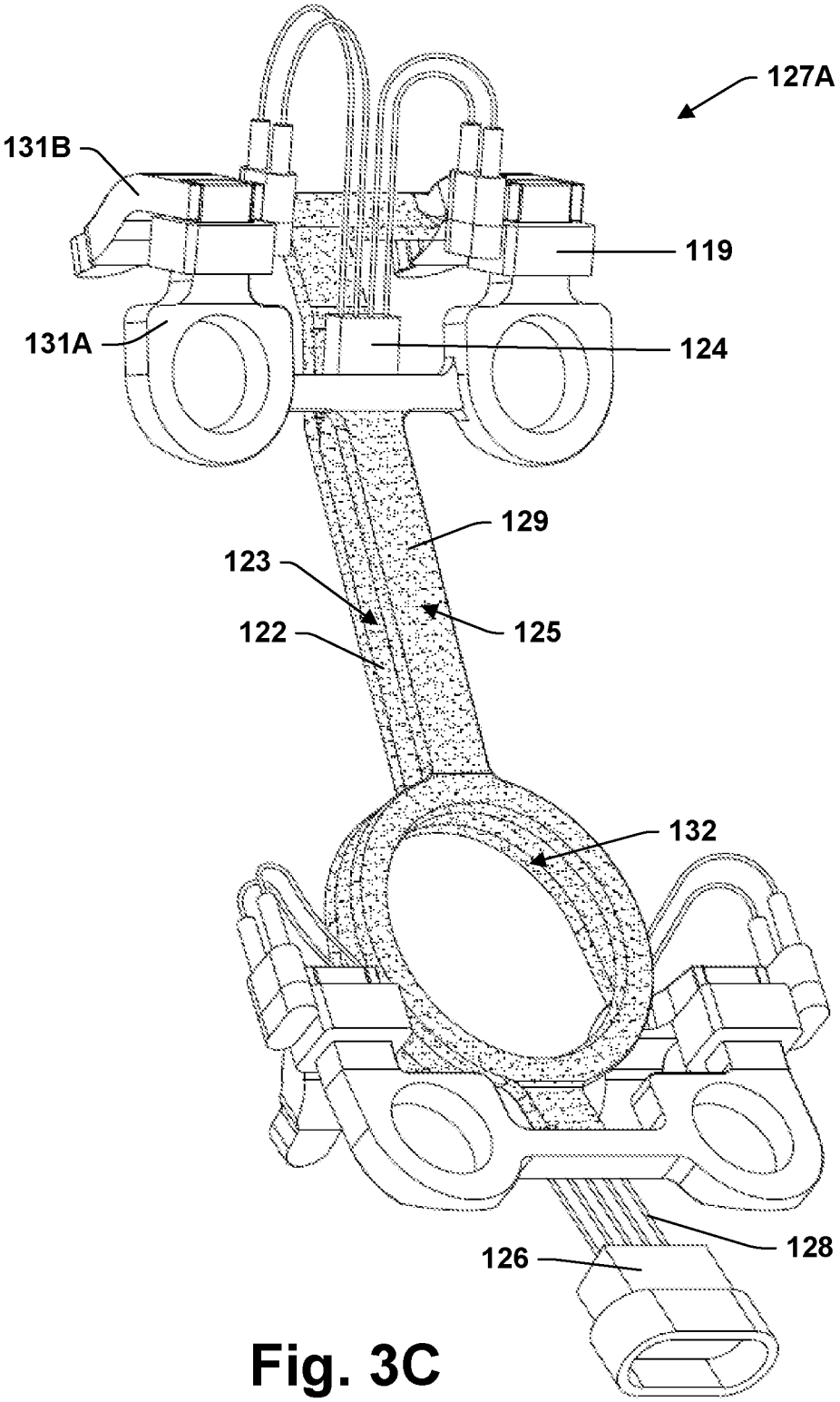
FIG. 3C provide a perspective view of four actuators 127A according to the present teachings incorporating the mounting frame of FIG. 3A.

As shown in FIGS. 3A-3C, mounting frame 123 may join with an upper frame 125 to support and protect a wiring harness 124. Wiring harness 124 includes wires 128 that provide power to electromagnets 119. Mounting frame 123 supports wiring harness 124 from below. Upper frame 125 may protect wires 128 from objects falling from above during manufacturing or maintenance. Upper frame 125 may include four pole pieces 131B and a paramagnetic connecting structure 129.

Wires 128 may all connect to a common plug 126. In some of these teachings, two of the electromagnets 119 are connected in series or in parallel. In some of these teachings, all four of the electromagnets 119 are connected in series or in parallel. These options reduce the number of wires in plug 126 and allowing a tradeoff between circuit costs and flexibility. For example, the intake and exhaust valves in a multi-valve engine may only be subject to deactivation in pairs. In some of these teachings, a plurality of electromagnets 119 share a common ground connection. In some of these teachings, one or more electromagnets 119 are grounded through cylinder head 130.

In accordance with some of the present teachings, mounting frame 123 is supported to two or more HLAs 181 that are angled with respect to one another when installed in their bores 174. This angling may restrict vertical movement of mounting frame 123. Mounting frame 123 may not fit over HLAs 181. In an installation method, two or more HLAs 181 may be slid through openings in mounting frame 123 into their bores 174. Electromagnets 119 and wiring harness 124 may be installed on mounting frame 123 either before or after this operation. Upper frame 125 may be connected to mounting frame 123 any time after the installation of electromagnets 119. Mounting frame 123 may be further secured with connectors attaching frame 123 to cylinder head 130.

Rather than being supported on HLAs 181, mounting frame 123 may be supported by cylinder head 130. Mounting frame 123 may still abut HLAs 181, whereby HLAs 181 facilitate proper position of the pole pieces 131 on mounting frame 123. In addition, mounting frame 123 may include a circular opening 132 that is shaped to fit around a spark plug tower (not shown). The spark plug tower may then also be used to achieve correct and stable positioning of pole pieces 131.

Mounting frame 123 may be part of a valve actuation module. In the present disclosure, a valve actuation module is a structure that includes a rocker arm assembly 115 and an actuator 127 according to the present disclosure. The actuator 127 may be mounted to a pivot for the rocker arm assembly 115. For example, the actuator 127 may be mounted to an HLA 181. In some of these teachings, the HLA 181 and the rocker arm assembly 115 are held together by a removable clip (not shown). The clip may hold HLA 181 and rocker arm assembly 115 together during shipping and through installation of valve actuation module within an engine 100.

Figure 4:
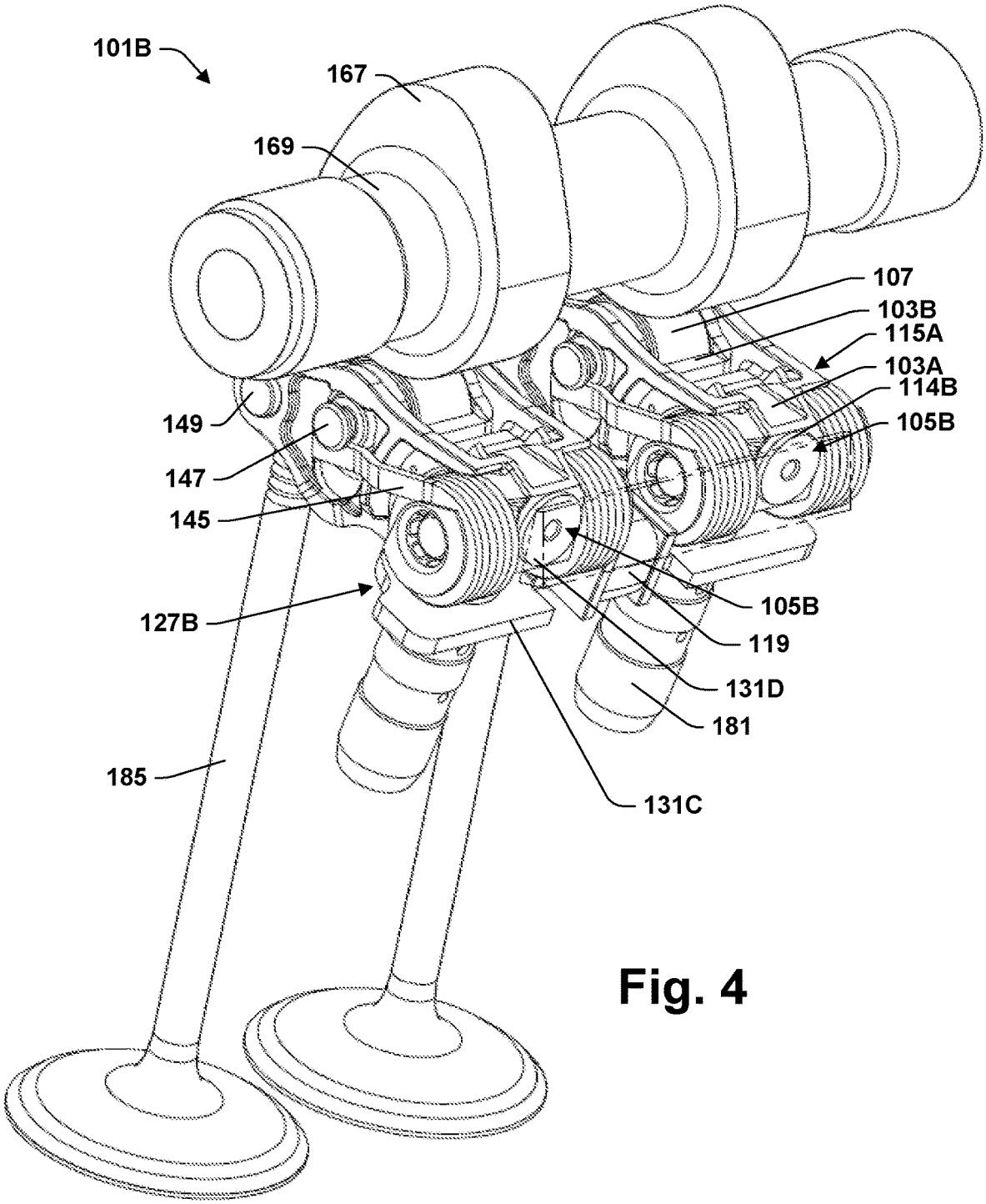
FIG. 4 provides a perspective view of a valvetrain according to some aspects of the present teachings with a pole piece shown in transparency.
Figure 5:
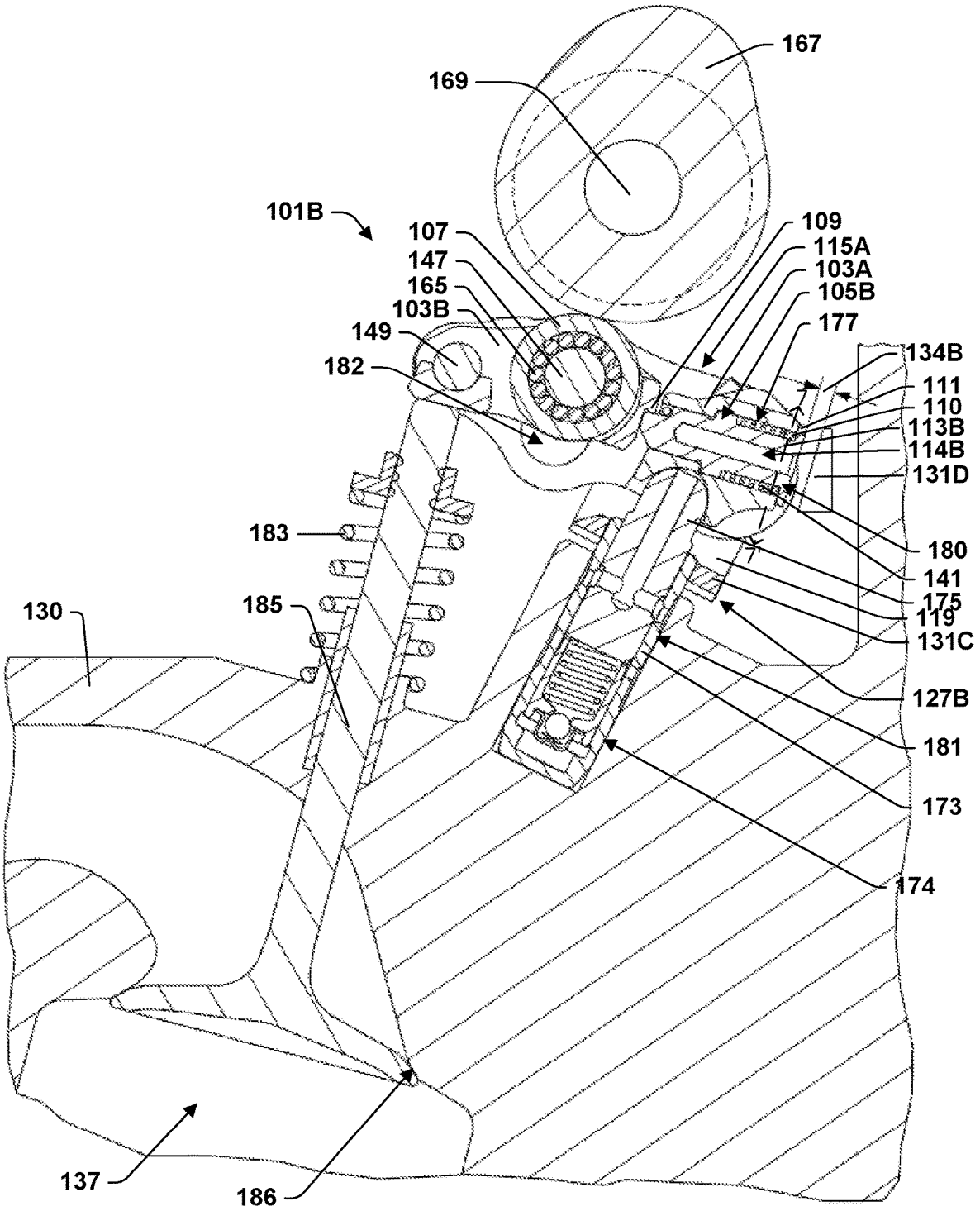
FIG. 5 is a partial cross-section of an internal combustion engine according to some aspects of the present teachings including a cross-section of the valvetrain of FIG. 4 through one of the rocker arm assemblies of that valvetrain.

FIG. 4 provides a perspective view of a portion of a valvetrain 101B according to some other aspects of the present teachings. Valvetrain 101B may be used in place of valvetrain 101A in engine 100A. FIG. 5 provides a cross-sectional view of what valvetrain 101B would look like in engine 100A. Valvetrain 101B may be the same as valvetrain 101A except that valvetrain 101B uses one or more latch assemblies 105B in place of one or more latch assemblies 105A. Latch assembly 105B includes actuator 127B and two latch pins 114B.

Figure 6:
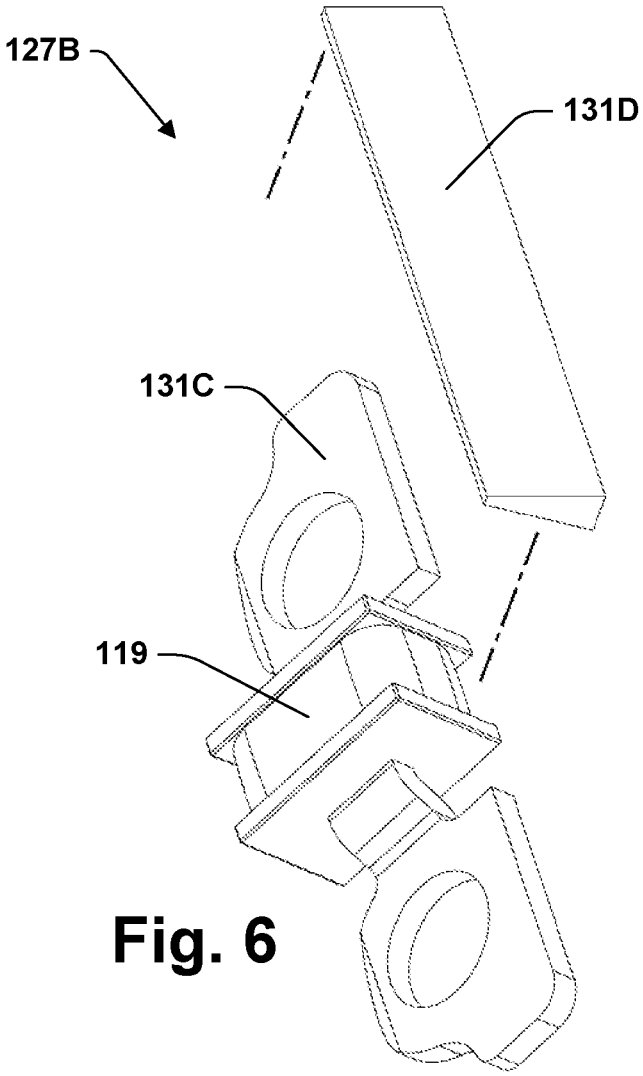
FIG. 6 is a perspective view of an actuator used in the valvetrain of FIG. 4.

FIG. 6 illustrates the parts of actuator 127B separately from other components of valvetrain 101B. Actuator 127B includes pole piece 131C, pole piece 131D, and electromagnet 119. Pole piece 131C may provide a core for electromagnet 119 and may be mounted to a pair of HLAs 181. Pole piece 131D may be mounted separately from pole piece 131C. As shown in FIGS. 4 and 5, pole piece 131D may be positioned between latch pins 114B and an outer portion of engine 101A, such as cylinder head 130. Pole piece 131D forms a low reluctance pathway for magnetic flux between two latch pins 114B. Pole piece 131D may be mounted to cylinder head 130.

Actuator 127B places electromagnet 119 between two adjacent rocker arm assemblies 115A. When electromagnet 119 is energized, it actuates the two latch pins 114B to their non-engaging position through magnetic flux that follows the magnetic circuit 220F illustrated in FIG. 7. Magnetic circuit 220F includes pole pieces 131C and 131D, two HLAs 181, two outer arms 103A, and two latch pins 114B. Magnetic flux from electromagnet 119 following magnetic circuit 220F proceeds from electromagnet 119 through pole piece 131C to one of the HLAs 181, up the HLA 181, through the associated rocker arm 103A, through the latch pin 114B mounted to that rocker arm 103A, across an air gap 134B to pole piece 131D, through pole piece 131D, across another air gap 134B to the other latch pin 114B, through the other rocker arm 103A, down through the other HLA 181, back into the pole piece 131C, and from there back to electromagnet 119. The magnetic flux polarizes low coercivity ferromagnetic materials throughout the circuit 220F and place magnetic force on latch pins 114B that causes them to actuate to the non-engaging position, narrowing the air gaps 134B in the process.

Figure 7:
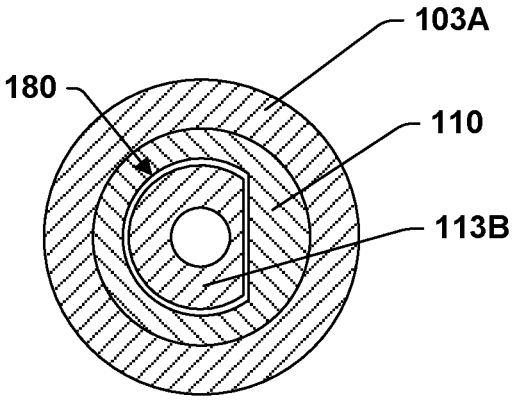
FIG. 7 is a cross section taken through the line 7-7' of FIG. 5.
Figure 8:
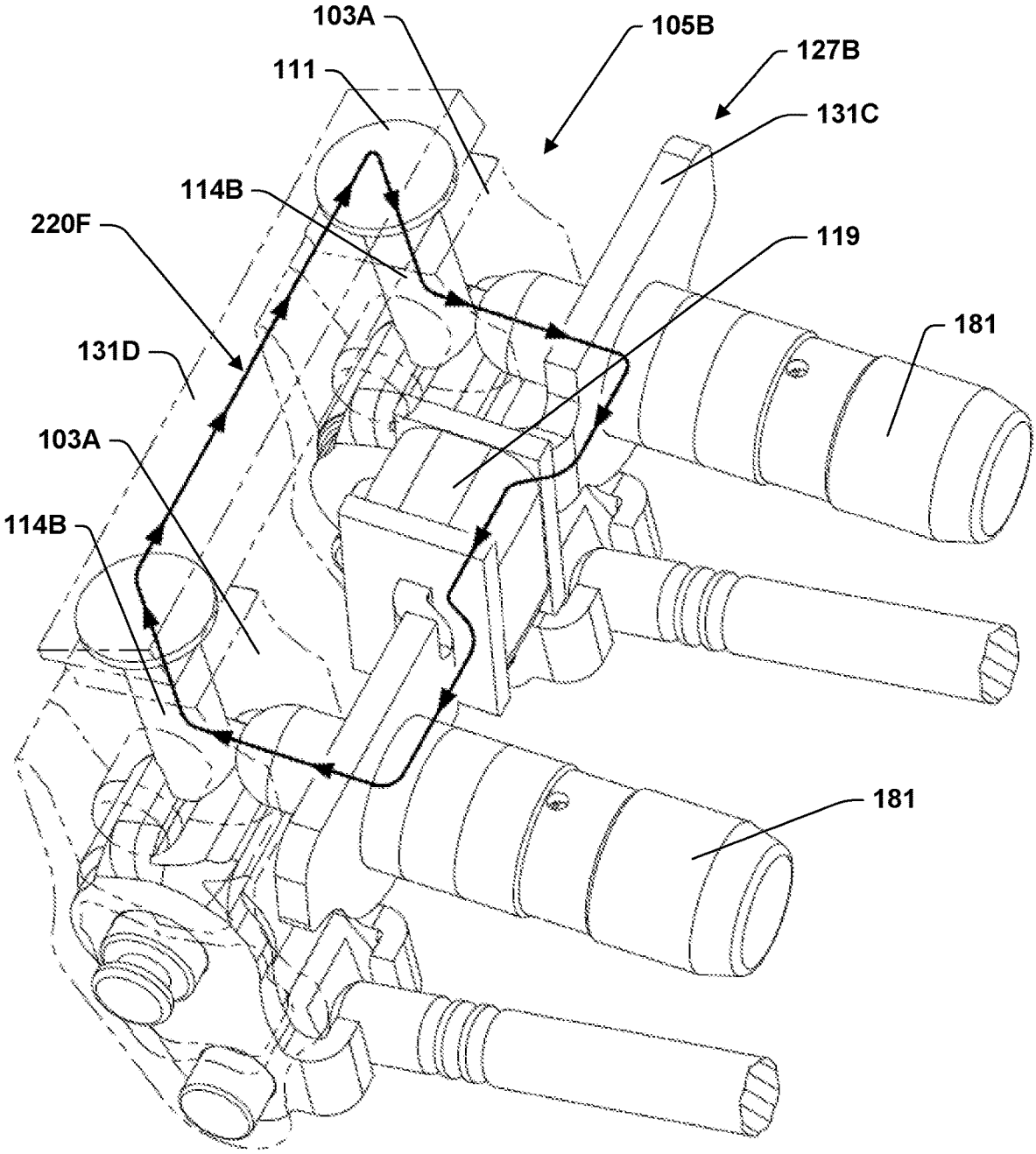
FIG. 8 is a perspective view of a portion of the engine of FIG. 5 showing some parts in transparency and illustrating a magnetic circuit according to some aspects of the present teachings.

Referring to FIG. 5, latch pin 114B is held within a chamber 177 of rocker arm 103A by a latch pin cage 110. Chamber 177 may have been originally designed to operate as a hydraulic chamber. In some of the present teachings, latch pin cage 110 is paramagnetic, which may improve the operation of latch assembly 105B. Latch pin cage may be press fit into chamber 177 or otherwise secured to prevent rotation with respect to rocker arm 103A. Referring to FIGS. 5 and 7, at one or the other end of chamber 177, there is an opening 180 through which latch pin 114B extends. In some of the present teachings, latch pin 114B has a non-circular profile where it passes through opening 180 and the shape of opening 180 cooperates with the profile of latch pin 114B to restrict rotation of the latch pin 114B. In this example, opening 180 has a D-shape and latch pin 114B has a mating D-shaped profile. In this way, latch pin 114B may be installed in chamber 177 with latch pin cage 110 providing an anti-rotation guide feature.

In accordance with some of the present teachings, latch pin 114B has an expanded end 111 that does not fit within the opening in rocker arm 103A out of which latch pin 114B extends. Expanded end 111 has a larger cross-sectional area than the core 113B of latch pin 114B that travels within hydraulic chamber 177. The large cross-sectional area of end 111 facilitates its interaction with pole piece 131D. In accordance with some of these teachings, pole piece 131D is mounted to be facing end 111 when cam 167 is on base circle. The facing surfaces may be parallel or nearly parallel. In some of these teachings, the facing surfaces are generally flat. In some of these teachings, latch pin 114 contacts an actuator pole piece 131 when latch pin 114 is in the non-engaging position. In some of these teachings, one or both of the contacting surfaces has one or more dimples. Dimples may be operative to prevent end 111 and pole piece 131D from contacting over a large surface area and potentially sticking together. In some of these teachings the facing surfaces are parallel or nearly parallel to a direction of lash adjustment provided by lash adjuster 181. This geometry may facilitate maintaining operability of actuator 127B over a range of lash adjustment.

The rocker arms 103 of the examples herein are all rocker arms that have been put into production for use with a hydraulically actuated latch. For example, with reference to FIG. 1A, latch pin 114A is installed within a hydraulic chamber 177 of rocker arm 103A. The surface 178 through which rocker arm 103A contacts hydraulic lash adjuster 181 is shaped to form a hydraulic seal with lash adjuster 181. In some of these teachings, rocker arm assembly 115 includes a dual feed hydraulic lash adjuster 181 that was put into production for use with a hydraulically latching rocker arm. Hydraulic lash adjuster 181 may include a port 179 configured to channel hydraulic fluid from cylinder head 130 to rocker arm 103A. For hydraulic operation, a port for hydraulic fluid is formed by drilling a hole in rocker arm 103A from surface 178 into hydraulic chamber 177. That is a post-production step that need not be carried out when rocker arm 103A is used for electromagnetic latching as described herein.

Figure 9:
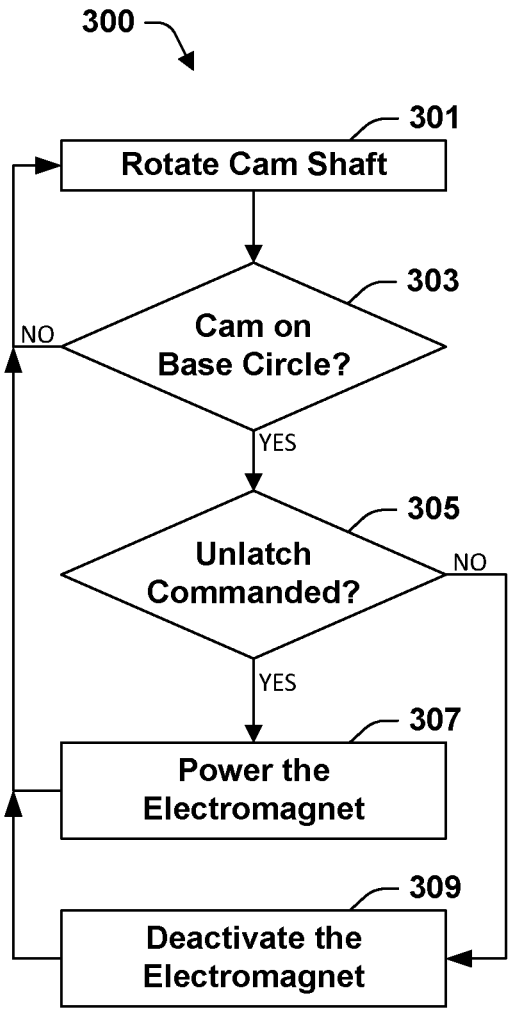
FIG. 9 is a flow chart of a method of operating an internal combustion engine according to some aspects of the present teachings.

FIG. 9 provides a flow chart of a method 300 that may be used to operate an engine 100 with a valvetrain 101. Method 300 may begin with act 301, rotating camshaft 169. Rotating camshaft 169 may be inherent in running engine 100. Act 303 checks whether cam 167 is on base circle. Act 303 may be used to ensure that latch pin 114 is actuated only when cam 167 is on base circle. Rather than simply limit the start of actuation to times when cam 167 is on base circle, act 303 may more narrowly limit the range of camshaft phase angles at which latch pin actuation may be initiated to ensure that actuation is complete before cam 167 begins to rise off base circle. Act 305 determines whether an unlatch command, such as a command to deactivate valve 185, is currently in force. If yes, method 300 proceeds with act 307, powering electromagnet 119 to actuate latch pin 114 if latch pin 114 is not already in the non-engaging position. If no and latch pin 114 is not already in the engaging position, method 300 proceeds with act 309 to deactivate electromagnet 119 thereby allowing latch pin 114 to actuate to the engaging position under the influence of spring 141 or the like.

In some aspects of the present teachings, act 307 generates magnetic flux that enters rocker arm 103A and actuates a latch pin 114 mounted on that rocker arm. Magnetic flux follows closed loops, so the flux that enters rocker arm 103A also leaves rocker arm 103A before returning to its source. In some of the present teachings, the flux that enters and leaves rocker arm 103A is sufficient to result in latch pin 114 actuating. The source of magnetic flux may be relatively stationary with respect to combustion chamber 137. Rocker arm 103A, on the other hand, is mobile with respect to combustion chamber 137. In some of these teachings, act 307 places a magnetic force directly on the latch pin 114. This force may initially actuate the latch pin 114 and subsequently maintain the position of latch pin 114 while engine 100 continues to operate through act 301.

Act 307 may power electromagnet 119 with either an alternating current (AC) or a direct current (DC). In some of these teachings, act 307 powers electromagnet 119 with a DC current. In some of these teachings deactivating electromagnet 119 cuts power to electromagnet 119 entirely. But in some of these teachings, deactivating electromagnet 119 simply reduces the current or changes it in such a way that latch pin 114 ceases to be held in the non-engaging position.

FIG. 9 provides a flow chart of an example method 310 according to some aspects of the present teachings. Method 310 may be used with valvetrain 101A, valvetrain 101B, or any other valvetrain in which a latch pin 114 mounted to rocker arm 103A is actuated using an electromagnet 119 operating through a magnetic circuit 220 having an air gap 134 that varies in width in relation to a motion of rocker arm 103A that actuates a poppet valve 185. Method 310 may be carried out simultaneously with method 300 and includes act 301, which has camshaft 169 in a state of rotation.

Act 311 is driving a circuit that includes electromagnet 119 to facilitate data collection. Driving the circuit may include pulsing the circuit. In some examples, a DC current pulse may be used. The default position for latch pin 114 could be either the engaging or the non-engaging configuration. A DC pulse could be applied on top of a DC current that is used to hold latch pin 114 in position. But in some of these teachings, the DC pulse is applied only when electromagnet 119 is not energized. In some examples, an AC current is applied to facilitate data collection while a DC current is used to actuate latch pin 114.

In some of these teachings, a circuit including electromagnet 119 is driven continuously over extended periods in a way that enables the data collection of act 313 but does not affect the position of latch pin 114. The current provided for data collection may be AC or DC. The periods may be in excess of the time taken for camshaft 169 to complete a rotation. In some examples, the current applied to facilitate data collection is insufficient in magnitude or duration to actuate latch pin 114. In some examples, the current applied to facilitate data increases the amount of force holding latch pin 114 in its current position.

Act 313 is data collection, which may take place while the circuit is being driven according to act 311. Data collection may include measuring a current or voltage in an electrical circuit comprising electromagnet 119. A time variation in that current or voltage may be measured. The data may be obtained using any suitable measuring device. Examples of measuring devices that may be suitable include, without limitation, a shunt resistor and a Hall effect sensor.

In an alternative provided by the present disclosure, the electrical circuit including electromagnet 119 is monitored passively, making action 311 optional. If there is magnetic flux in a circuit comprising electromagnet 119, any expansion or contraction of air gap 134 will produce a change in that flux and induce a current in electromagnet 119. That induced current may be detected and analyzed to determine the change in air gap 134. In some of these teaching, a permanent magnet is configured to continuously maintain a magnetic flux in a magnetic circuit comprising electromagnet 119. That flux may be insufficient to hold latch pin 114 in any particular position.

Act 315 is using the collected data to obtain position information for rocker arm 103A. An instantaneous rocker arm position may be determined. Alternatively, a set representing data collected over a span of time may be analyzed to determine, for example, a valve lift profile. The data will depend on the inductance of the circuit, which will depend on the inductance of electromagnet 119, which will depend on the magnetic reluctance of magnetic circuit 220, which will depend on the size of air gap 134, which will depend on the pivot angle of rocker arm 103A on the fulcrum provided by HLA 181, which determines the amount by which valve 185 has been lifted of its seat 186. Analyzing the data may include one or more of comparing the data to results obtained during calibration, comparing the data to model predictions, comparing the data to data obtained during a previous cam cycle, comparing the data to data obtained at other cam phases, and comparing similar data obtained from other rocker arms.

The size of air gap 134 is also affected by the position of latch pin 114. Therefore, method 310 may be modified or extended to provide a determination of whether latch pin 114 is in the extended or retracted position. In some of these teachings, information obtained from the circuit comprising electromagnet 119 is used to distinguish among three states. In the first state, latch pin 114 is in the non-engaging configuration. In the second state, latch pin 114 is in the engaging configuration and cam 167 is on base circle. In the third state, latch pin 114 is in the engaging configuration and cam 167 is off base circle. The determination of the third state may further include a determination of rocker arm position.

Act 317 is performing an operation using the rocker arm position information derived in act 315. In some of these teachings, the operation of act 317 is a diagnostic. A diagnostic operation may include a reporting step. The report may be made selectively. The report may be sending a signal, such as illuminating a warning light. In some of these teachings, the diagnostic operation includes recording a diagnostic code in a data storage device. The diagnostic code may later be read by a technician.

Some of the diagnostic determinations that may be made using the rocker arm position data include determining whether there is wear in one or more valve lift components, determining whether there is a collapsed lifter, determining whether valve float is occurring, and determining whether there is a broken valve spring. Some of these diagnostics may involve making several rocker arm position determinations to obtain sufficient information relating to a current valve lift profile. Some of these diagnostics may involve observing a variation in valve lift profile over time.

Figure 10:
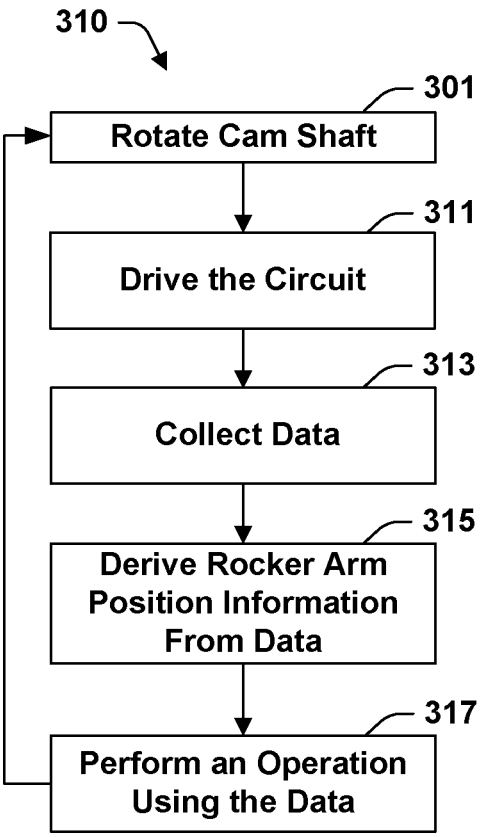
FIG. 10 is a flow chart of a diagnostic method according to some aspects of the present teachings.

In some of these teachings, method 310 or one of the variations thereof described above is used to detect a critical shift in rocker arm assembly 115A. A critical shift is the case where latch pin 114 comes out of the engaging position while cam 167 is lifting rocker arm 103B. If this happens, rocker arm 103A will be driven by valve spring 183 to rapidly pivot from a lifted position like the one shown in FIG. 10 to its base circle position shown in FIG. 1D. In some of these teachings, a critical shift is detected from the speed with which inductance or a related property varies. In some of these teachings, a critical shift is detected from an induced current in the circuit. In some of these teachings, a critical shift is detected from data indicating a premature return to base circle.

In some of these teachings, the operation of act 317 is an engine management operation. An engine management operation is one that affects a running state of engine 100. For example, the rocker arm position information may be use in a control algorithm. In some of these teachings, the rocker arm position information is used to provide camshaft position information and the camshaft position information is used in the control algorithm. The present teaching of using rocker arm position information to obtain camshaft position information and using that camshaft position information to control an engine is independent of the method by which the rocker arm position is determined or the structure used to determine the rocker arm position. The rocker arm position may be determined using any suitable device and method.

The camshaft position may be determined with greater accuracy or reliability by combining the rocker arm position information with position data from another rocker arm. The camshaft position information may be used in the same way as information from a conventional camshaft position sensor. The information may be used, for example, to determine the timing of an ignition or a fueling event. Crankshaft position information may be used in conjunction with the camshaft position information within the engine management operation. The rocker arm position information may be used to augment or substitute for the information provided by a camshaft position sensor. Here, the term camshaft position sensor is used in the sense of a device known in the industry as a camshaft position sensor.

A camshaft position sensor of a conventional type provides coarse data regarding camshaft position. Rocker arm position information can provide more precise camshaft position data. That higher precision data may be enabling for certain applications. One such application is a method of operating a cylinder deactivating rocker arm assembly actuated by a two-lobe cam. The latch can be engaged and disengaged with each cam cycle whereby the valve is lifted by one of the lobes but deactivated with respect to the other lobe.

The approximate shape of the valve lift profile may be known. Accordingly, as few as two data points may be sufficient to determine the rate of camshaft rotation and the current position (phase angle) of the camshaft. Greater numbers of data points may be used to perform statistical analysis to improve the accuracy of these determinations and/or refine a representation of the shape of the valve lift profile.

The analysis of rocker arm position information may be used to identify one or more critical points in the cam cycle. Critical points in the cam cycle include the point at which the rocker arm begins to lift and the point at which the rocker arm completes its decent. These events are closely related to valve opening and valve closing. The point at which the rocker arm reaches maximum lift is also of interest. It may be desirable to collect rocker arm position data while the rocker arm is near the point of maximum lift to obtain measurements with a high signal to noise ratio. In some of these teachings, a determination of camshaft position is used in setting the timing for a subsequent measurement of rocker arm position.

The components and features of the present disclosure have been shown and/or described in terms of certain aspects and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A method of operating an internal combustion engine of a type that has a combustion chamber, a moveable valve having a seat formed in the combustion chamber, a camshaft on which a cam is mounted, and a rocker arm assembly having a rocker arm and a cam follower configured to engage the cam as the camshaft rotates, the method comprising:

obtaining rocker arm position data;

obtaining camshaft position data based on the rocker arm position data; and performing an engine management operation based on the camshaft position data.

2. The method of claim 1, wherein the engine management operation is performed by a controller that is not receiving data from a camshaft position sensor.

3. The method of claim 1, wherein the obtaining of the camshaft position data further comprises determining a time at which the rocker arm reached maximum lift.

4. The method of claim 1, wherein the performing of the engine management operation further comprises determining a phase relationship between the camshaft and a crankshaft based on the camshaft position data in conjunction with data from a crank angle sensor.

5. The method of claim 1, wherein the engine management operation comprises controlling a cam phaser.

6. The method of claim 1, wherein the cam includes two lift lobes.

7. The method of claim 6, wherein:

a latch pin is mounted on the rocker arm; and the method further comprises actuating the latch min twice per cam cycle, whereby through two or more cam cycles the latch pin is engaged whenever the cam follower is on one of the two lift lobes and disengaged whenever the cam follower is on a remaining one of the two lift lobes.

8. The method of claim 1, wherein:

the internal combustion engine has a latch assembly comprising a latch pin that is mounted on the rocker arm;

the latch assembly comprises an electromagnet that is operative to cause the latch pin to translate between a first position and a second position; and the obtaining of the rocker arm position data comprises gathering and analyzing data relating to a current or voltage in an electrical circuit that includes the electromagnet.

9. The method of claim 8, wherein:

the electromagnet moves the latch pin between the first position and the second position through magnetic flux that follows a magnetic circuit that passes through the latch pin and includes an air gap between the latch pin and a pole piece that is mounted to a component distinct from the rocker arm; and the rocker arm assembly and the latch assembly are structured such that the air gap varies in width in relation to a motion of the rocker arm that actuates the moveable valve.

10. The method of claim 9, wherein:

the electromagnet is mounted to the component distinct from the rocker arm or a second component distinct from the rocker arm; and the rocker arm is configured to move independently from the electromagnet.

11. The method of claim 8, further comprising:

pulsing the electrical circuit with a pulse insufficient in amplitude or duration to actuate the latch pin;

wherein the current or voltage is induced by the pulse.

12. The method of claim 8, wherein:

the current or voltage is sustained over a cam cycle; and the current or voltage does not actuate the latch pin.

13. The method of claim 8, further comprising:

powering the electrical circuit with a DC current configured to actuate the latch pin; and the rocker arm position data is obtained while powering the electrical circuit with an AC current.

14. The method of claim 8, further comprising:

detecting a position of a second rocker arm so as to obtain second rocker arm position data; and wherein the obtaining of the camshaft position data is further based on the second rocker arm position data.

15. A method of operating an internal combustion engine of a type that has a combustion chamber, a moveable valve having a seat formed in the combustion chamber, a camshaft on which a cam is mounted, a rocker arm assembly having a rocker arm and a cam follower configured to engage the cam as the camshaft rotates, and a latch assembly having a latch pin that is mounted on the rocker arm and an actuator having an electromagnet, the method comprising:

analyzing data relating to a current or voltage in an electrical circuit comprising the electromagnet so as to obtain camshaft position data; and performing an engine management operation based on the camshaft position data;

wherein the electromagnet is operative to cause the latch pin to translate between a first and a second position through magnetic flux that follows a magnetic circuit that passes through the latch pin and includes an air gap between the latch pin and a part that is mounted on a component distinct from the rocker arm; and the rocker arm assembly and the latch assembly are structured such that the air gap varies in width in relation to a motion of the rocker arm that actuates the moveable valve.

16. The method of claim 15, wherein the performing of the engine management operation further comprises determining a phase relationship between the camshaft and a crankshaft based on the camshaft position data in conjunction with data from a crank angle sensor.

17. The method of claim 16, wherein:

the electromagnet is mounted to the component distinct from the rocker arm or a second component distinct from the rocker arm; and the rocker arm is configured to move independently from the electromagnet.

18. The method of claim 15, wherein the engine management operation comprises controlling a cam phaser.

19. The method of claim 15, further comprising:

pulsing the electrical circuit with a pulse insufficient in amplitude or duration to actuate the latch pin;

wherein the current or voltage is induced by the pulse.

20. The method of claim 15, further comprising:

powering the electrical circuit with a DC current to actuate the latch pin;

wherein the data relating to the current or voltage that is analyzed is obtained while powering the circuit with an AC current.

* * * * *